United States Patent [19]

Chelton et al.

[11] 4,102,350

[45] Jul. 25, 1978

[54] APPARATUS FOR REMOVING EXCESS COATING MATERIAL ACCUMULATED AT THE INTERIOR EDGE PORTIONS OF METAL CONTAINERS

[75] Inventors: Raymond G. Chelton, Chicago; Elmer C. Ginther, Oak Forest; Mihailo Djordjevic, Dolton, all of Ill.

[73] Assignee: The Continental Group, Inc., New York, N.Y.

[21] Appl. No.: 745,892

[22] Filed: Nov. 29, 1976

[51] Int. Cl.[2] ..... B08B 3/02

[52] U.S. Cl. ..... 134/130; 134/67; 134/152; 134/184; 118/410; 118/423; 427/336

[58] Field of Search ..... 134/67, 130, 131, 147, 134/152, 169 R, 182, 184; 118/410, 423, 50; 21/79, 80; 427/352, 353, 336

[56] References Cited

U.S. PATENT DOCUMENTS

| | | | |
|---|---|---|---|
| 2,295,575 | 9/1942 | Gladfelter | 118/101 |
| 2,461,559 | 2/1949 | Martin et al. | 134/152 X |
| 2,599,455 | 6/1952 | Huseman | 134/130 |
| 2,635,614 | 4/1953 | Ford | 134/130 |
| 2,821,491 | 1/1958 | Fleming | 427/336 X |
| 3,022,791 | 2/1962 | Larson | 134/131 X |
| 3,210,182 | 10/1965 | Funari | 228/19 |
| 3,218,193 | 11/1965 | Isaacson | 427/345 |
| 3,710,759 | 1/1973 | Tardoskegyi et al. | 118/410 X |
| 3,713,876 | 1/1973 | Lavric | 118/423 X |
| 3,948,212 | 4/1976 | Mayer | 118/50 |
| 4,020,198 | 4/1977 | Cornelius et al. | 118/423 X |

*Primary Examiner*—Wm. Carter Reynolds
*Attorney, Agent, or Firm*—Paul Shapiro; Joseph E. Kerwin; William A. Dittmann

[57] ABSTRACT

A washing apparatus is disclosed for removing excess coating material from the interior edge portions of metal containers wherein the excess material is formed by the coating draining down the interior sidewalls of the container after the coating has been applied thereto. The apparatus is provided with means for contacting the interior edge portions of the container in the seaming area with a wash fluid wherein the wash fluid maintained in a receptacle is discharged from a slot contained in the receptacle in the form of a ripple having waves which swell and undulate within the interior of the container to effect a washing action on the coating material accumulated therein to remove the coating material from the interior edge portions.

4 Claims, 2 Drawing Figures

APPARATUS FOR REMOVING EXCESS COATING MATERIAL ACCUMULATED AT THE INTERIOR EDGE PORTIONS OF METAL CONTAINERS

BACKGROUND OF THE INVENTION

1. Field of the Invention

This invention relates to removing excess coating material which accumulates on freshly coated metal containers and more particularly relates to the removal of coating material which accumulates in the interior end areas of coated containers.

2. The Prior Art

A method of metal container manufacture in current use by the metal container industry is the two-piece can process. This process involves forming a drawn cup from a metal sheet and then deep drawing the cup into a can configuration. After the can body is completely configurated and decorated, but before the end is assembled onto the body, the interior surface of the can body is coated with a protective coating of a synthetic resin material.

It is now conventional practice in the metal container industry to apply, as the coating material, a heat hardenable resin dispersed in an aqueous medium which is sprayed into the interior walls of the container. The wet coated container is then passed through an oven in which hot air is circulated to evaporate the aqueous medium and harden the coating. In one particular method of coating two-piece cans with water dispersed heat hardenable coating materials, used by the present applicant, the open-ended can is caused to be passed in an inverted position over a reservoir of aqueous coating material which is flooded into the can interior. Excess coating material is removed to a large extent from the interior of the can by draining. However, one drawback to the use of this method, is that the viscosity and surface tension properties of the aqueous based coatings are such that after draining, there is often remains an excessive accmulation or bead of coating material on the interior edge portions of the open end of the container which are to be flanged preparatory to the application of an end closure for sealing the container by double seaming. This accumulation of coating material in the flange area is generally large enough to interfere with the double seaming operations used to the affix the closures and such interference permits leakage of the closed container.

In copending patent application Ser. No. 471,540, filed May 20, 1974, by Ihab M. Hekal, there is disclosed a method for coating the interior portions of metal containers with aqueous dispersions of heat hardenable resins wherein the coating is sprayed into the interior of the container while inverted on a reticulated belt and the wet coating is then allowed to drain. Thereafter, the container is heated to effect drying and hardening of the applied coating material. Removal of excess coating left from the draining which accumulates about the interior sidewall portions immediately adjacent the open end of the container is effected by spraying the exterior walls of the container before the heating step. Due to the difference in surface tension between the aqueous dispersion accumulated on the interior of the open end area and the water draining past the exterior of this area, a portion of the wash water draining past the exterior portion of the open end area of the container is pulled by capillary action towards the interior of the container whereby it intermixes with and dilutes the bead of accumulated resin dispersion. The so diluted resin coating dispersion is of such lowered concentration that upon drying the hardened coating is of an acceptable thickness that will not materially interfere with double seaming operations.

Although the method disclosed in Ser. No. 471,540 is effective to remove a major portion of the bead of accumulated resin, the method does not completely solve the problem encountered with accumulated coating material. It has been found, that even after the exterior wall water wash procedure disclosed in Serial No. 471,540, during the time interval after the wash and before heat hardening of the coating, the wet coating continues to drain down the interior sides of the container accumulating again at the edge portions of the container as well as in the interstices of the reticulated belt. Thereafter, when the container is heated, the coating material accumulated on the interior edge portion of the container is sometimes still present in sufficient amounts to interfere with double seaming operations and the coating material accumulated in the interstices of the belt when hardened fouls and plugs the belt causing the coating line to be shut down at frequent intervals for cleaning and removal of the accumulation of hardened coating.

SUMMARY OF THE INVENTION

Briefly stated the present invention provides an apparatus and method for removing excess coating material accumulated at the interior end portion of container during the coating of the container with liquid dispersed coating materials wherein the interior edge portions of the open end of the container are contacted with a wash fluid for effecting the removal of the accumulated coating material, the fluid contacting the interior edge portions of the container being trickled in contact with the container in the form of a ripple having waves which swell within the interior or the container to wash the sidewalls of the container with which it has contact so as to effect the removal of the accumulated coating material.

The practice of present invention applied to containers coated with aqueous coating dispersion reduces the thickness of excess coating material accumulated about the interior edge of the containers in the closure sealing area to a degree that any coating that remains does not interfere with the closure seaming operations. Further, the practice of the present invention also effects substantial removal of coating drained into the interstices of the reticulated belt upon which the containers are carried during the coating operation so that fouling of the belt is substantially eliminated.

Figure 1:
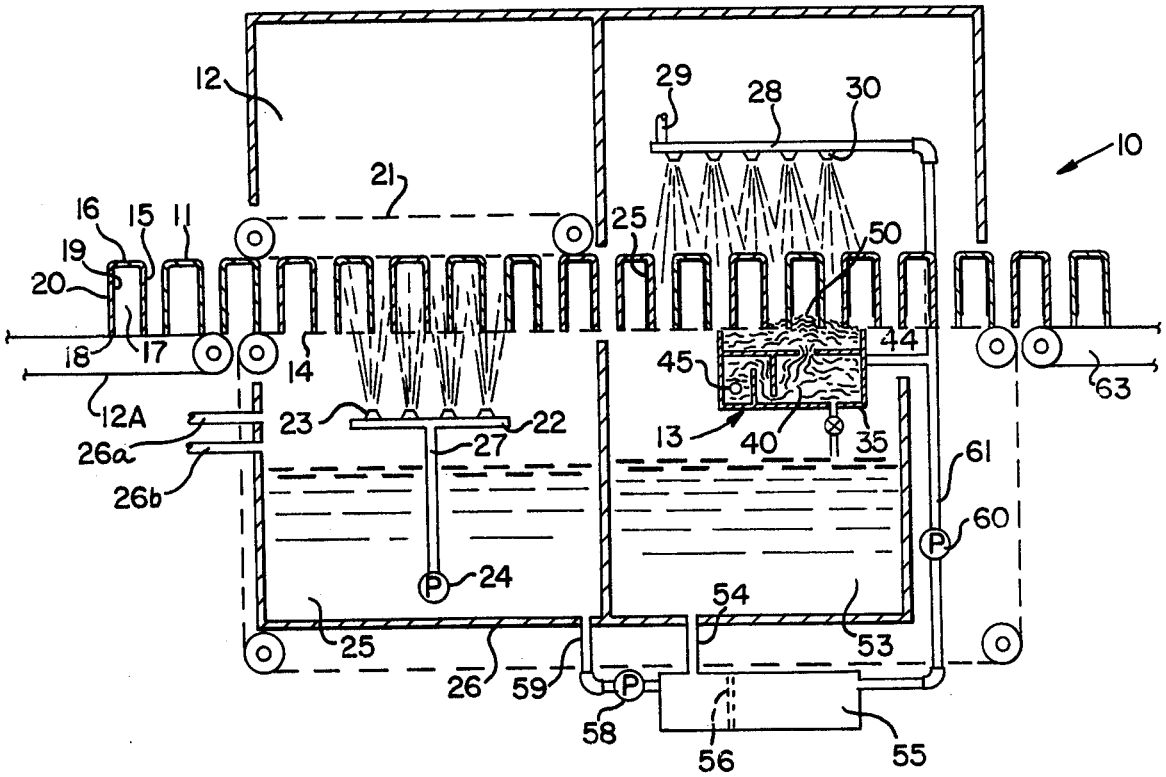
FIG. 1 is a side elevation of a container coating line wherein an apparatus of the present invention is employed.

Referring more particularly to FIG. 1, there is shown a coating apparatus generally indicated at 10 which includes the apparatus of the present invention designated generally at 13. Metal containers 11, which have been previously cleaned and washed (in an apparatus not shown) to remove any traces of extraneous metal, lubricating oil and other contaminants derived from the container forming process are delivered while still wet, in an upright, inverted position to coating tunnel 12 by conveyor or endless belt 12A and are there transferred to an endless reticulated belt 14. The containers 11 are comprised of side walls 15 closed at one end with end member 16 (which may be integral with the container sidewalls) and having a remaining open portion 17 having an end 18.

Upon entering the coating tunnel 12, the closed ends 16 of the containers 11 are contacted with a second reticulated belt 21. The belt 21 serves to support the containers 11 during their travel through the coating tunnel 12 and prevents the containers 11 from falling as they are subjected to aqueous coating resin sprays. As the containers 11 travel through the coating tunnel 12, the interior surface walls 19 of the containers are contacted with an aqueous dispersion of a heat hardenable resin by means of a spraying member 22 provided with a plurality of nozzles 23 which are disposed under the belt 14 and which are effective to direct an atomized spray of wet resin coating material onto the interior container walls 19. The spraying member 22 communicates with any suitable means, such as pump 24, which supplies aqueous resin dispersion material 25 under pressure to the spray member 22 from storage tank 26 through pipe 27. Excess coating material is allowed to drain from the container 11 and to flow by gravity back into tank 26. Coating material 25 depleted from the tank 26 is replaced with water and resin material supplied to the tank 26 through pipes 26*a* and 26*b* from respective water and resin storage means (not shown).

After the aqueous resin dispersion 25 is applied to the interior surfaces of the container 11, the containers 11 are passed under a water spray member 28 connected by pipe 29 to a source of water (not shown). The spray member 28 contains nozzles 30 by means of which the exterior walls 20 of the containers 11 are sprayed with water. The water as it drains down the exterior walls of the container tends to intermix, by capillary action with coating material accumulated on or in the interior area of the open end 18. The dilution of the accumulated coating material causes a portion of the accumulated coating material to be released from the interior surface of the container and drain away from the open end area 18.

Immediately after the application of water to the exterior walls of the container, the edge portions of the open ends of the containers 11 are contacted with a ripple of of water which is trickled from the washer apparatus 13 of the present invention.

Figure 2:
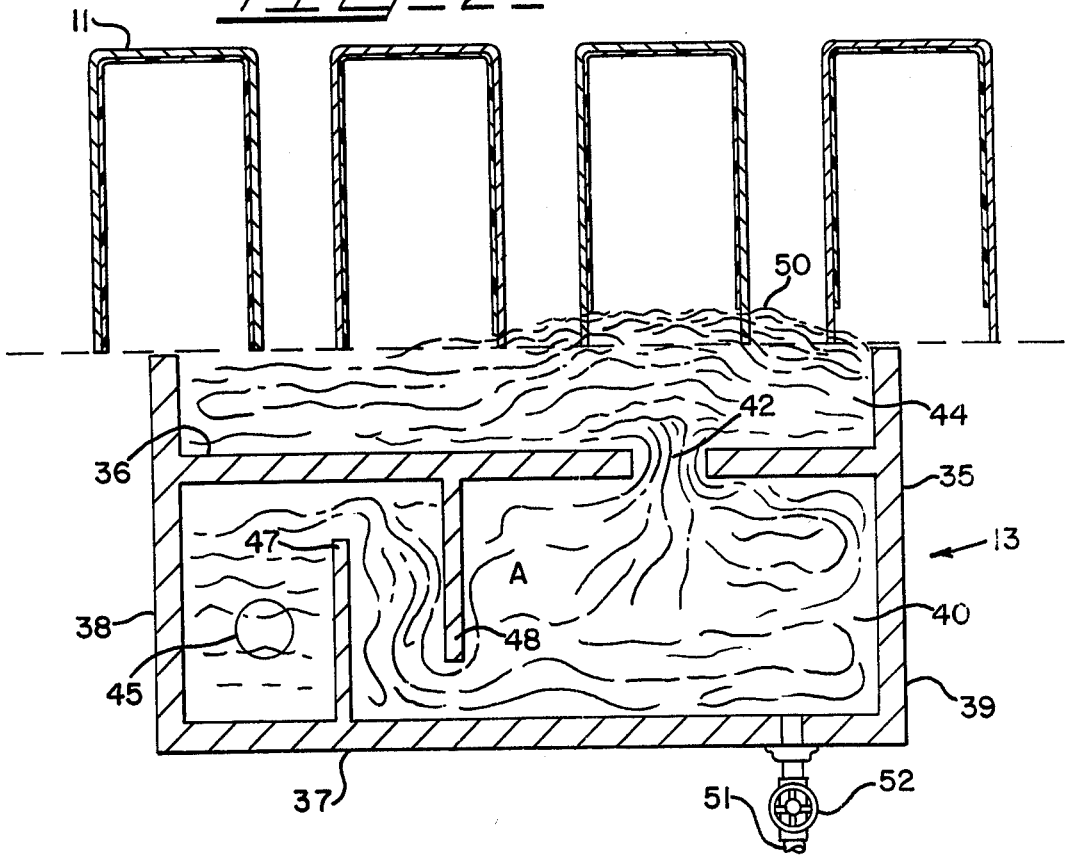
FIG. 2 is a sectional view taken along the line 2—2 of FIG. 1.

Referring now to FIG. 2, the washer unit 13 is constructed of a receptacle 35 provided with upper wall 36, bottom wall 37 and sidewalls 38, 39. The walls form fluid chamber 40 which receives the surface treating fluid A, which in the present instance will be assumed to be water, although the water may include other ingredients within the scope of the invention. Upper wall 36 is provided with slot 42. The sidewalls 38, 39, project beyond the upper wall 36 and form with the upper wall 36 a reservoir 44. Located within the fluid chamber 40 at the side thereof furtherest from the slot 42 is feed pipe 45. The receptacle in the area adjacent the pipe 45 is partially longitudinally subdivided by parallel spaced partitions 47, 48 which project from the upper and bottom walls of the container in line with the side walls 38, 39. Partition 47 projects upwardly from the bottom wall 37 of the receptacle 35 and terminates at a distance from the upper wall 36. Partition 48 projects downwardly from the upper wall 36 of the receptacle 35 and terminates at a distance from the bottom wall 37. The partitions 47, 48 maintain the fluid A in the fluid chamber 40 at a relatively constant, predetermined pressure i.e. the partitions baffle any surges in fluid pressure attendant to the delivery of fluid to the chamber 40. The fluid A is arranged in the receptacle 35 to approximately the levels indicated in the drawings, namely the fluid completely fills the chamber 40 of the receptacle 35 as well as the reservoir 44. As the reservoir 44 is filled with fluid discharged through slot 42, a wave or swell of fluid 50 is formed in the area of the reservoir adjacent the slot 42 of a height sufficient to contact the lower interior sidewalls of the containers 11 which pass above the reservoir 44 inverted on the reticulated belt 14.

In operation, the fluid A is drawn from a suitable source (not shown) and is forced under pressure through feed pipe 45 into the fluid chamber 40 of the receptacle 13. When the fluid chamber 40 is completely filled with fluid A, the fluid overflows the chamber 40 through slot 42 and is discharged into the reservoir 44. As the reservior 44 fills, a fluid swell forms in the area of the slot 42 and as sufficient hydrostatic pressure builds, the swell impinges against the edges and interior sidewalls of the inverted containers 11 which pass overhead on reticulated belt 14. The partitions 47, 48 deflect and baffle the flow of fluid discharged from the pipe 45 into the chamber 40 to reduce any turbulance in the water flow discharged through the slot 42 and thereby adjusts and diffuses the pressure of the fluid swell 50 so that the swell produced in the area of the slot trickles into contact with the interior sidewalls of the container to wash the sidewalls and remove the accumulated coating material without disturbing the equilibrium of the unsupported containers.

By adjusting the pressure and flow rate of the water discharged into the reservoir 44 from the slot 42, the height of the wave 50 is adjusted to swell up sufficiently to contact the edges and the immediately adjacent sidewll portions of the containers, 11, e.g., about ⅛ to 0.5 inch up the container walls, to wash and remove any coating adherent thereto as well as any coating and other extraneous material that may adhere to the reticulated belt 14.

In practice, water pumped into the fluid chamber 40 of the receptacle 35 at a feed rate of 35 gallons per minute and a pressure of 1–2 pounds per square inch and discharged into the reservoir through a $3/_{16}$ inch slot using an apparatus of the type shown in the drawing creates a wave in the reservoir having a height of 0.25 inch at its maximum point which projects about 0.25 inch up the side walls of containers which pass over the reservoir on a reticulated belt moving at the rate of about 12 feet per/minute to effect substantially complete removal of any coating material from the container sidewalls contacted as well as any extraneous coating material entrained in the interstices of the belt 14. By contacting the containers in this manner the wave produced trickles against the containers so that the equilibrium is undisturbed.

Referring to FIGS. 1 and 2, the bottom wall 37 of the washer 13 is provided with a drain pipe 51 which allows for draining of the receptacle into collection tank 53. Collection tank 53 also collects fluid which may overflow from the reservoir 44 as well as the effluent which drains off the container walls. The overflow from the reservoir and the drained water effluent contains a small but economically valuable amount of resin material. The reservoir overflow and effluent collected in tank 53 is pumped (by means not shown) through pipe 53 to suitable filtration means such as ultrafilter 55. The ultrafilter 55 is equipped with a semipermeable membrane 56 adapted to separate high molecular weight resins from fluid media. The fluid material collected in tank 53 is pumped to the "upstream" or feed zone of the membrane. This concentrated resin dispersion is pumped from the ultrafilter 55 by means of pump 56 through pipe 59 to storage tank 26. The fluid separated from the effluent referred to as "permeate" is pumped by pump 60 through pipe 61 to the spray member 28 to be reemployed in the washing of the exterior walls of the container bodies.

After the containers 11 have been washed by washer 13, they are conveyed out from the coating runnel 12 and transferred to suitable conveyor means 63 whereby the containers 11 are conducted to a drying oven (not shown) to effect hardening of the coating material applied to the interior walls of the container body as well as to evaporate any water remaining on the container bodies.

We claim:

1. An apparatus for removing excess coating material accumulated at the interior edge portion of an open end of a metal container which portion is to be subjected to double seaming after the excess coating material is removed, the apparatus comprising a receptacle adapted to contain a supply of wash fluid capable of diluting the accumulated coating, a movable reticulated web for conveying the coated container in an upright inverted position with the open end contacting the web, means for moving the web over the receptacle, means for continuously trickling the wash fluid upwardly from the receptacle through the web into contact with the interior edge portion of the container at a flow rate which does not materially effect the position of the inverted container, the trickle of wash fluid being in the form of a ripple having waves of a height sufficient to contact the interior edge portion of the container which is to be subjected to double seaming and which swell within the container interior to effect a washing action on the accumulated coating material.

2. The apparatus of claim 1 wherein the receptacle is provided with means for baffling the flow of fluid in the receptacle to maintain the fluid trickle at a relatively constant, predetermined pressure.

3. The apparatus of claim 1 including a fluid reservoir located immediately below the web and means for discharging fluid from the receptacle into the reservoir in the form of a wave of a height sufficient to contact the interior portions of the container which are to be subjected to double seaming.

4. The apparatus of claim 3 wherein the means for discharging fluid is provided with slot means through which fluid from the receptacle is discharged into the reservoir.

* * * * *